US005104246A

United States Patent [19]

Musso et al.

[11] Patent Number: 5,104,246

[45] Date of Patent: Apr. 14, 1992

[54] STRIKER DEVICE FOR PRINTERS

[75] Inventors: Pietro Musso, Ivrea; Francesco Benedetto, Caluso; Paolo Valero, Ivrea, all of Italy

[73] Assignee: Ing. C. Olivetti & C. S.p.A., Torino, Italy

[21] Appl. No.: 526,705

[22] Filed: May 22, 1990

[30] Foreign Application Priority Data

Jun. 8, 1989 [IT] Italy ..... 67457 A/89

[51] Int. Cl.[5] ..... B41J 9/38

[52] U.S. Cl. ..... 400/157.2; 400/167; 101/93.32; 101/93.48

[58] Field of Search ..... 400/144.2, 167, 157.2, 400/157.3, 689; 101/93.02, 93.28-93.34, 93.48

[56] References Cited

U.S. PATENT DOCUMENTS

| | | | |
|---|---|---|---|
| 4,239,401 | 12/1980 | Veale | 101/93.34 |
| 4,308,794 | 1/1982 | Adamoli et al. | 400/157.2 |
| 4,401,026 | 8/1983 | Brown | 101/93.02 |
| 4,422,784 | 12/1983 | Arzowmanian et al. | 400/144.2 |
| 4,529,326 | 7/1985 | Mattsson | 400/157.2 |
| 4,530,280 | 7/1985 | Kaneko et al. | 400/167 |
| 4,595,304 | 6/1986 | Fujioka | 400/157.2 |
| 4,708,501 | 11/1987 | Takemoto | 400/157.2 |
| 4,744,684 | 5/1988 | Maekawa | 400/167 |
| 4,783,610 | 11/1988 | Asano | 101/93.48 |
| 4,900,169 | 2/1990 | Falconieri et al. | 400/157.2 |

*Primary Examiner*—Edgar S. Burr
*Assistant Examiner*—Christopher A. Bennett
*Attorney, Agent, or Firm*—Banner, Birch, McKie & Beckett

[57] ABSTRACT

A striker device for use in printers comprises a platen roller, a character-carrying disc and a print hammer for striking a character of the disc against the roller. The print hammer is actuated by an armature which is movable in an impact direction by virtue of electromagnetic excitation of a stator body. The device includes strike-silencing means comprising sliding guide surfaces between the print hammer and the armature, which ensure freedom of movement for the armature with respect to the hammer in the impact sense and direction, and a ring of elastomeric material which is interposed between the armature and the print hammer and which transmits the kinetic energy of the armature to the print hammer with a delay. Particular ratios between the masses 'Mh' and 'Ma' of the hammer and the armature and between the levels of hardness 'Kr' and 'Kp' of the elastomeric ring and the roller provide a single but prolonged strike on the part of the print hammer.

26 Claims, 4 Drawing Sheets

STRIKER DEVICE FOR PRINTERS

BACKGROUND OF THE INVENTION

The present invention concerns a striker device for printers, comprising a printing support, a character-carrying member having individually movable characters, a print hammer which is actuable in an impact sense and direction to cause a selected character of the character-carrying member to strike against the printing support, and an actuating member movable to actuate the print hammer.

European Patent Application No. 0 206 701 discloses a striker device for typewriters in which the actuating member comprises an armature which is fixed to the hammer and which is actuated electromagnetically. The hammer and the armature are biased into a rest position by a return spring and a counterweight and suitable damping elements limit the oscillations of the hammer about its rest position. The weight of the hammer and the armature is about 5 grams and the energy for the striking operation is produced by imparting a substantial speed to the assembly. That device is reliable and fast but the printing thereof is rather noisy.

The striking noise is closely linked to the energy imparted by the hammer and the duration of the impact and, other conditions being equal, the intensity thereof increases with the increase in deformation of the roller and the desired printing strength. The striking noise is characterized by frequencies which rise in inverse relationship to the duration of the impact, and the noise nuisance also increases with increases in those frequencies. The behaviour of the roller can be compared to that of an elastic-dissipative oscillating system. In particular a hammer-armature group of mass 'M' which strikes against the roller induces an oscillation, the frequency of which is approximately:

$$f = \sqrt{Kp/M - |C/2M|^2},$$

in which 'Kp' and 'C' represent coefficients of hardness and damping of the roller. In the systems of known type, a reduction in the amount of noise by means of a reduction in the degree of hardness 'Kp' and an increase in the mass 'M' encountered a limit in the reduction in printing efficiency and in the increase in bulk of the actuating unit.

U.S. Pat. No. 4,668,112 discloses a striker device for a daisywheel-type typewriter in which the intensity of the striking noise is reduced and the frequency thereof is lowered, by increasing the striking time by means of a substantial increase in the striking mass. For that purpose the hammer is pivoted to the carriage of the machine on which the daisywheel is mounted and receives its motion from a transverse bar of large mass, which is pivoted to the frame structure of the machine parallel to the roller and to which the hammer is connected slidably, transversely with respect to the roller. The bar is in turn actuated by a moving-coil electromagnet controlled by a control circuit for prolonging the striking force. That arrangement is of a weighty structure in order to withstand the forces acting at the transverse bar without deformation and it is of high cost due to the complexity and the output power of the pilot control circuits.

U.S. Pat. No. 4,327,639 discloses a striker device for daisywheel-type printers in which the print hammer and the armature are mounted on a support frame structure which is pivotally mounted about an axis on the carriage which is parallel to the roller. The hammer is connected to the support frame structure by means of a highly flexible double leaf spring which, at the moment of the striking action improves the coupling of the character to the hammer. Then, while the armature continues with its movement, the leaf springs activate a second striking action on the part of the hammer in order to improve transfer of the ink from the typing ribbon to the paper, even in circumstances involving low levels of energization of the hammer. The printers which use that device are however noisy.

SUMMARY OF THE INVENTION

An object of the present invention is to provide a striker device for a printer which is simple, light and of low cost and which has a low level and a low frequency of striking noise, without adversely affecting the quality and strength of printing.

That object is achieved by the striker device according to the invention which is characterized by silencer means comprising guide means capable of ensuring freedom of movement for the actuating member with respect to the print hammer in the impact sense and direction, and an element of elastomeric material interposed between the actuating member and the print hammer and such as to transmit with a delay the kinetic energy of the actuating member to the print hammer.

BRIEF DESCRIPTION OF THE DRAWINGS

A preferred embodiment of the invention is set forth in the following description which is given by way of non-limiting example and with reference to the accompanying drawings in which.

DETAILED DESCRIPTION OF THE PREFERRED EMBODIMENTS

Figures 1, 9:
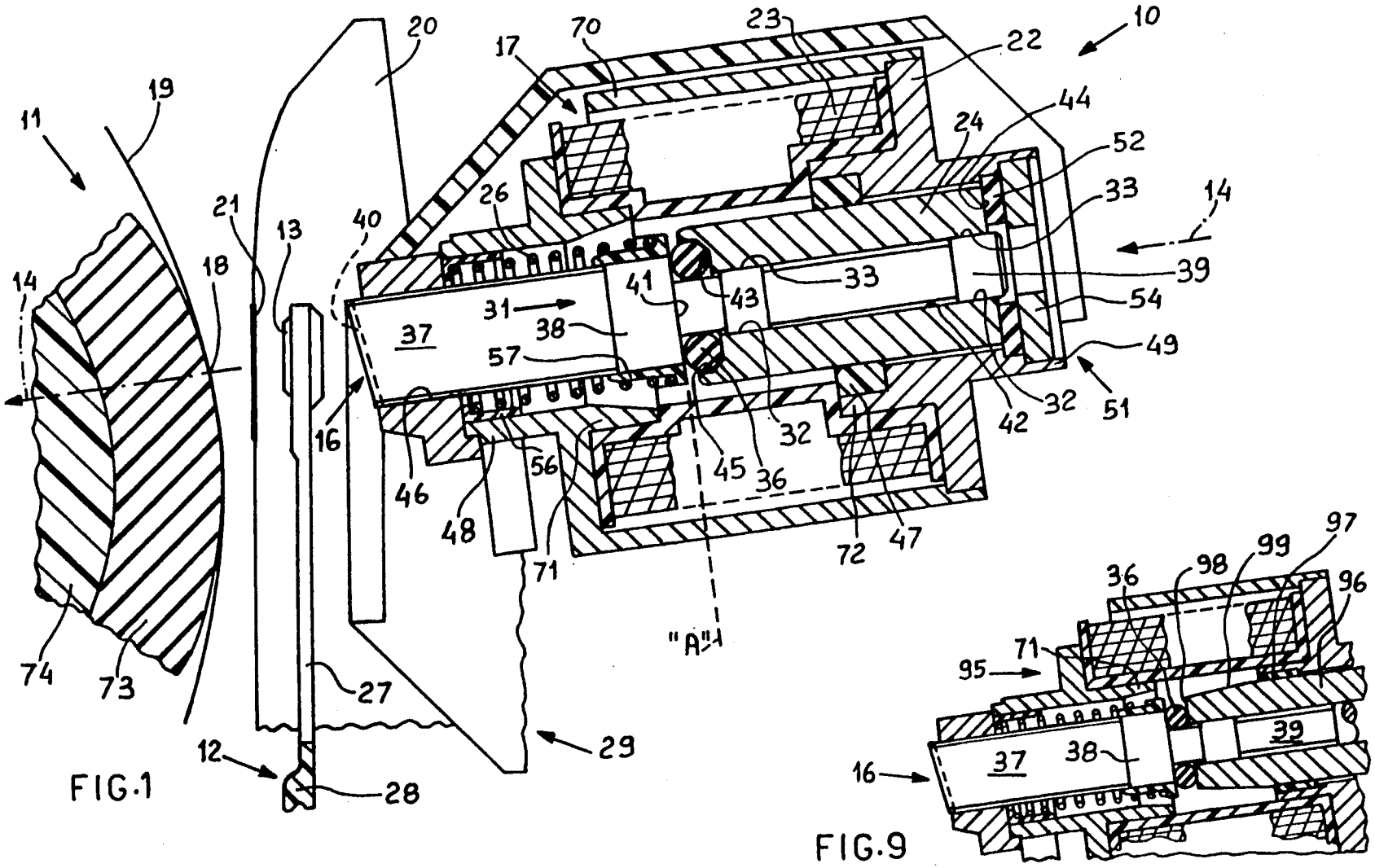
FIG. 1 is a longitudinal view of part of a printer on which the striker device according to the invention is mounted.
FIG. 9 is a second alternative form of the device shown in FIG. 1.

Referring to FIG. 1, the striker device embodying the invention which is indicated by reference numeral 10 is applied to a printer comprising a printing support or platen roller 11 and a character-carrying member 12 of the type having characters 13 which are individually movable in an impact sense and direction 14. The device 10 comprises a print hammer 16 which can be actuated by an actuating unit 17 to cause the character 13 to impact at a printing point 18 on the roller 11 against a sheet of paper 19 carried by the roller 11, with the interposition of a typing ribbon 21 guided by guides 20.

The actuating unit 17 comprises a stator body 22 of ferromagnetic material, a winding 23 for inducing electromagnetic excitation of the stator body 22, and an actuating member formed by a movable armature 24. The armature 24 is of ferromagnetic material and is capable of movement in response to excitation of the stator body 22 to actuate the print hammer 16 in the impact direction 14. A return spring 26 is arranged to return the hammer 16 towards a rest position 'A' together with the armature 24, in the direction 14, in the opposite sense to the impact movement and in the absence of excitation in respect of the stator body 22.

The character-carrying member 12 comprises a character-carrying disc 28 in which the characters 13 are individually carried by corresponding flexible blades 27. The blades 27 can be selected in front of the printing point 18 in response to a rotary movement of the disc 28 and flex in the impact direction 14 when they are hit by the print hammer 16. The disc 28 and the striker device 10 are carried by a printing carriage 29 which is movable transversely with respect to the roller 11. Printers of that type are widely known and further details thereof are therefore not set forth herein.

In accordance with the invention the striker device 10 is characterized by silencing means 31 which are intended to increase the length of the striking time and which do not substantially increase the striking mass. The silencing means 31 comprise guide means 32 and 33 which are capable of ensuring freedom of movement for the armature 24 with respect to the hammer 16 in the impact sense and direction 14, and an element 36 of elastomeric material which is capable of transmitting the kinetic energy of the armature 24 to the hammer 16, with a delay.

The print hammer 16 is of an elongate configuration in the direction 14 and comprises a first terminal portion 37, an intermediate portion 38 and a second terminal portion 39. The terminal portion 37 is of a parallelepipedic shape and is provided at one of its ends with a striking surface 40 having a V-shaped recess co-operable with a corresponding V-wedge-shaped profile on the character 13 for the striking action of the character 13, substantially as described in U.S. Pat. No. 4,308,794 assigned to the assignee of the present application. The intermediate portion 38 and the second terminal portion 39 are of cylindrical shape. The portion 39 is of a reduced section relative to the section of the portion 38 and the portion 38 defines a transverse surface 41 of annular shape, with respect to the portion 39.

The armature 24 is of a cylindrical shape coaxial with the impact direction 14 and comprises an axial cavity 42 capable of accommodating the terminal portion 39 of the hammer 16, with freedom of movement thereof. At its front and rear ends respectively, the armature 24 comprises a first transverse surface 43 which faces towards the roller 11 and which is provided at the bottom of an annular recess 45, and a second transverse surface 44 which is directed in the opposite direction with respect to the roller 11. The guide means 32 and 33 comprise two pairs of sliding cylindrical coupling surfaces on the portion 39 of the hammer 16 and the cavity 42 in the armature 24 respectively. In particular the first pair of surfaces 32 and 33 is adjacent to the intermediate portion 38 and the terminal portion 43 and the second pair of surfaces 32 and 33 is adjacent to a free end of the terminal portion 39 and to the terminal surface 44.

The element 36 of elastomeric material is formed by a ring of toroidal section (referred to as an O-ring) which is disposed around the terminal portion 39 of the hammer 16 and which is confined between the transverse surface 41 of the portion 38 of the hammer 16 and the transverse surface 43 of the armature 24, being partially-accommodated in the recess 45.

The hammer 16 and the armature 24 are guided in the impact direction 14 by a pair of bushes 46 and 47. The first bush 46 is fixed to a rear portion 48 of the stator body 22 and slidably co-operates with the terminal portion 37 of the hammer 16, and the second bush 47 is fixed to a front portion 49 of the stator body 22 and co-operates with the cylindrical surface of the armature 24.

The striker device 10 is also provided with a travel-limiting damping assembly indicated at 51, comprising a ring 52 of elastomeric and preferably viscoelastic material which is fixed to a travel-limiting plate 54 which in turn is fixed to the front part 49 of the stator body 22. The second transverse surface 44 of the armature 24 is capable of co-operating with the ring 52 of viscoelastic material in the rest position 'A' of the hammer 16.

The return spring 26 is compressed between a seat 56 of plastics material which is fixed to the rear portion 48 of the stator body 22 and a seat 57 also of plastics material which is fixed to the cylindrical portion 38 of the hammer 16. The rest position 'A' of the hammer 16 is thus defined by the action of the return spring 26 on the hammer 16, which is resisted by the travel-limiting plate 54, by means of the ring 52 of viscoelastic material, the armature 24 and the element 36 of elastomeric material.

Figure 4:
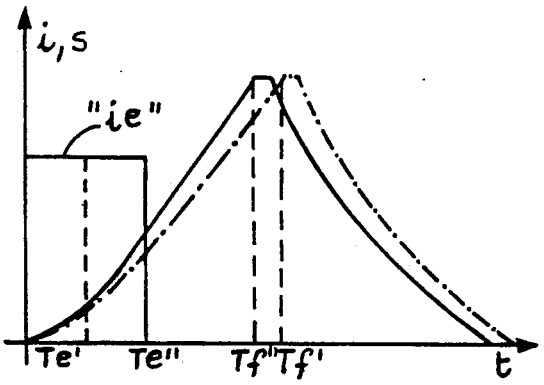
FIG. 4 is an operational diagram of the device shown in FIG. 1.
Figure 3:
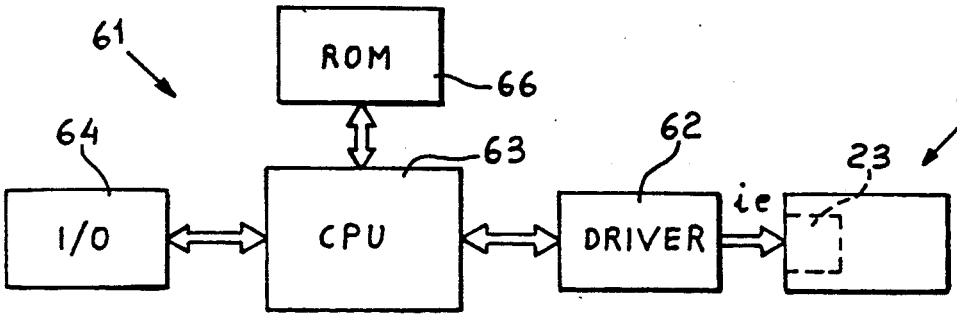
FIG. 3 is a block circuit diagram of a control circuit of the device shown in FIG. 1.

The winding 23 on the stator body 22 is capable of excitation by means of an actuating circuit 61 (see FIG. 3) of the printer, which circuit is known per se and which is capable of generating current pulses "ie" with a pilot-control or driver circuit 62 thereof. The duration of the pulses "ie" is controlled by a microprocessor 63 on the basis of information relating to the required strength of printing and coming from indications on the part of the operator, which are received by an input unit 64, and from coded data concerning the dimensions of the character 13 to be printed, said dimensions being received from an ROM 66. The duration of the current pulse "ie" is therefore variable between two time intervals Te' and Te" (see FIG. 4) which are less than the corresponding times Tf' and Tf" which the print hammer 16 will require in order to reach the roller 11 from its rest position 'A', substantially as set forth in abovementioned U.S. Pat. No. 4,308,794. As the braking action of the spring 26 is negligible, printing of the character 13 is therefore of ballistic type. The circuit also provides for generating pulses for damping the oscillations of the hammer 16 in the vicinity of its rest position, in a per se known manner, without same being shown in the diagram.

Figure 2:
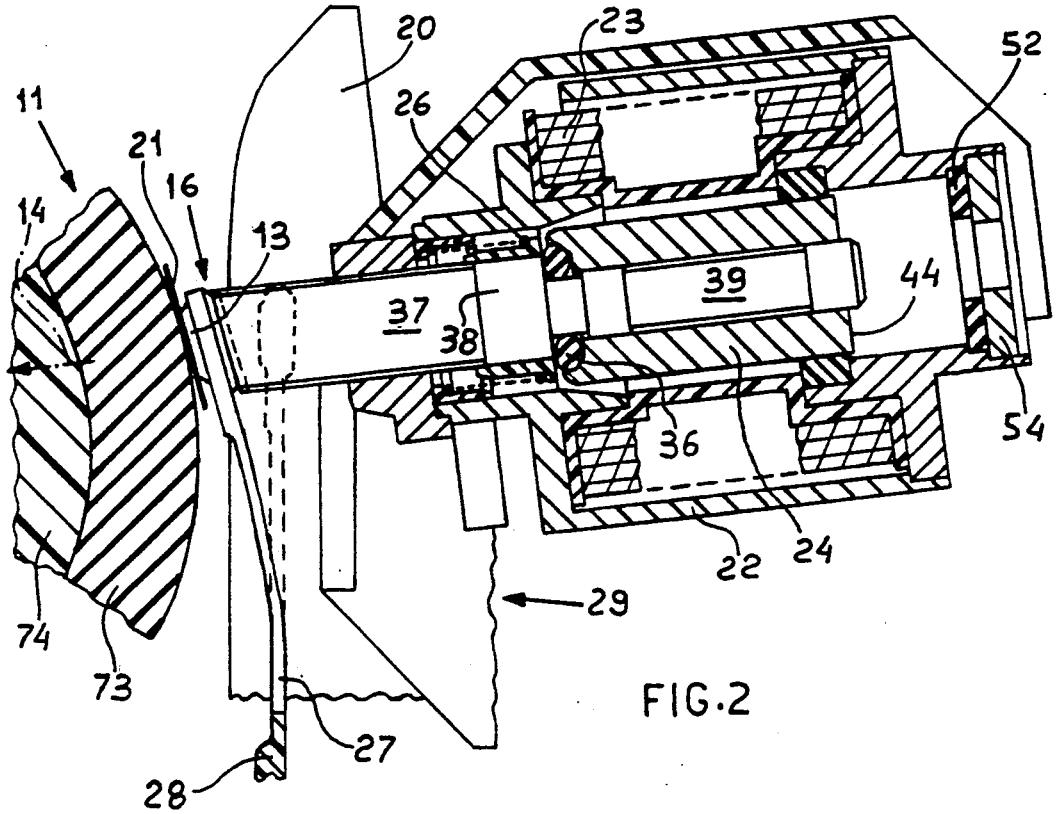
FIG. 2 is a longitudinal view on a reduced scale of the device shown in FIG. 1 in an operating position.

The stator body 22 (see FIG. 1) comprises a main body 70 of hollow cylindrical shape and provided on its rear portion 48 and its front portion 49 with two internal pole pieces 71 and 72 which are also hollow and which are axially symmetrical with respect to the direction 14. The pole pieces 71 and 72 accommodate within them the spring 26 and the terminal portion 37 of the hammer 16, and the armature 24 and the terminal portion 39 respectively, and with the portions of the armature 24 which are opposite the transverse surface 43, define a main air gap which is variable with the movement of the armature 24. The bush 47 is housed at a position corresponding to the pole piece 72 and ensures a secondary air gap of negligible reluctance between the pole piece 72 and the cylindrical surface of the armature 24. The pole piece 71 in turn comprises a negative tapering of frustoconical configuration which can be in facing relationship with a frustoconical bevel at the front end of the armature 24 adjacent to the recess 45 in an actuated position (see FIG. 2) of the armature 24.

For the purposes of producing a low level of striking noise, while being compatible with printing of good quality, the printing support 11 comprises a sheath 73 of nitrile rubber (NBR) of a hardness of between 45 and 60 Shore D and preferably 52±2 Shore D, on a solid core 74 of heavy material.

The striker device 10 operates in a first phase of excitation of the stator body 22 (see FIG. 1) as if the hammer 16 and the armature 24 were rigidly fixed together. In particular, in response to the excitation pulse "ie" at the winding 23, the armature 24 is actuated and reduces the main air gap of the magnetic circuit and moves towards the pole piece 71 in the impact sense and direction 14. In its movement the armature 24 entrains therewith the hammer 16, after initial compression of the element 36 and against the force of the spring 26.

Upon termination of the pulse "ie", while the armature 24 continues its movement due to the effect of inertia thereof, the hammer 16 (see FIG. 2) meets the character 13, flexes the blade 27 and, after meeting the ribbon 21, moves the character 13 and the ribbon 21 to hit the sheath 73 on the roller 11. The sheath 73 is initially deformed due to the effect of transfer of kinetic energy of the mass 'Mh' of just the hammer 16 and the elastic reaction of the sheath 73 applies a force to the hammer 16 in the opposite direction to the impact direction. Because of the deceleration of the hammer 16, the arriving armature 24 of mass 'Ma' compresses the elastomeric element 36 and thus transmits its kinetic energy to the hammer 16 by means of the element 36, with a delay. That prolongs the duration of contact between the assembly consisting of the hammer 16 and the character 13, and the sheath 73.

After the striking action, the hammer 16 and the armature 24 together reverse their direction of movement, due to the forces acting thereon as a result of the reaction of the roller 11 and the return spring 26. That movement is stopped by the action of the ring 52 of viscoelastic material on the transverse surface 44 of the armature 24. The action is then completed by the hammer 16 (see FIG. 1) which, after compression of the ring 36, transfers its kinetic energy to the armature 24, which in turn is again dissipated by the ring 52 and in part the element 36.

In accordance with the invention the ratio between the mass 'Ma' of the armature 24 and the mass 'Mh' of the hammer 16 and the dimension of and the material used for the ring 36 are calculated in such a way as to provide contact which is prolonged as much as possible between the hammer 16, the character 13, the typing ribbon 21 and the roller 11, without any adverse effect in terms of the quality of printing with respect to that of striker devices having the print hammer rigidly connected to the armature.

Figure 5:
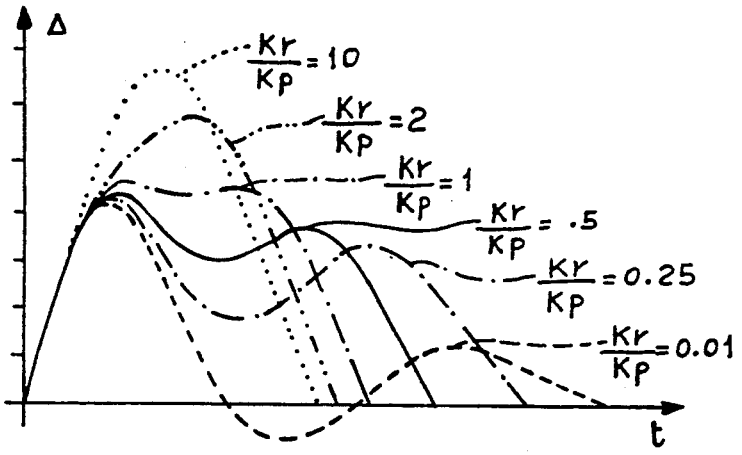
FIG. 5 is a graph showing the performance of the device shown in FIG. 1, upon a variation in a design parameter.

FIG. 5 shows as approximations diagrams illustrating penetration of the roller in dependence on time for different values of the ratio between the hardness or rigidity 'Kr' and 'Kp' of the ring 36 of elastomeric material and the sheath 73 of the roller 11, without altering the ratio between the mass 'Mh' of the hammer 16 and the mass 'Ma' of the armature 24 (that ratio being equal to ⅔rds). Those curves are related to the dotted-line curve which concerns the case of a ring 36 of high rigidity (Kr/Kp greater than 10) to which can be compared a rigid assembly of hammer and armature (minimum impact time).

Values of Kr/Kp between 1 and 0.25 provide a substantial increase in the length of the impact time and a reduction in maximum deformation of the roller. To achieve a strength of printing effect equal to that of a solid assembly of hammer and armature, it will be necessary to provide a slight increase in the striking energy involved but, even with that increase, the striking noise will be substantially reduced. The best result is achieved with the preferred embodiment which provides a ratio Kr/Kp=0.5. An excessively reduced value of Kr/Kp, for example 0.01, corresponding to the dashed-line curve, gives rise however to a second striking action on the part of the hammer 16 which is not acceptable since it causes blurring of the printed character and an excessively low level of printing efficiency.

Figure 6:
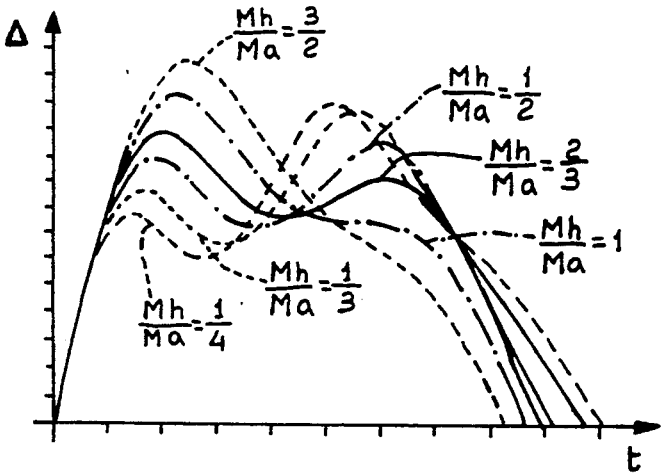
FIG. 6 is a graph showing the performance of the device illustrated in FIG. 1, upon a variation in another design parameter.

The diagrams in FIG. 6 approximately show penetration of the roller 11 caused by the device 10 in dependence on the ratio between the mass 'Mh' of the hammer 16 and the mass 'Ma' of the armature 24, while maintaining constant the value of the mass of the assembly M=Mh+Ma and the ratio (equal to 0.5) between the levels of rigidity 'Kr' and 'Kp' of the ring 36 and the roller 16. Optimum penetration of the roller is obtained with values of the ratio Mh/Ma which are between 1 and 0.5 or even 0.25, and, for structural design reasons, preferably for values Mh/Ma=⅔±0.2, and most preferably 0.65±0.05.

In the preferred embodiment, with equality of performance, the dimensions and characteristics of the device 10 according to the invention are very similar to those of a corresponding striker device with a rigid hammer-armature assembly which is well-tried in Olivetti typewriters of the series ET 2000 and substantially as described in European Application 0 206 701. The mass 'Mh' of the hammer 16 is about 2.7 grams and the mass 'Ma' of the armature 24 is about 4.1 grams, for an overall mass which is about 30% higher than the mass of the rigid hammer-armature assembly of the preceding device. With equal strength of striking, the device according to the invention is substantially interchangeable with the preceding device.

The diameter of the armature 24 is about 8 mm and the outside diameter of the ring 36 is about 6.2 mm, which represents about 80% of the diameter of the armature 24. The section of the ring 36 is of a diameter of between 18% and 24% of the diameter of the armature 24. Preferably it is about 1.8 mm, equal to 20% of the diameter of the armature 24.

The ring 36 is made of fluorinated rubber (FPM), for example of the type known as Viton A from Du Pont, with a hardness of between 55 and 80 Shore A, and preferably a hardness of between 65 and 75 Shore A, such as to provide a mean rigidity equal to 50% of the mean rigidity of the roller 11. Similar values can be achieved by suitably varying the levels of hardness, dimensions and shape of the element 36. The ring 52 is also made of fluorinated rubber with a level of hardness of between 60 and 80 Shore A.

Figure 7:
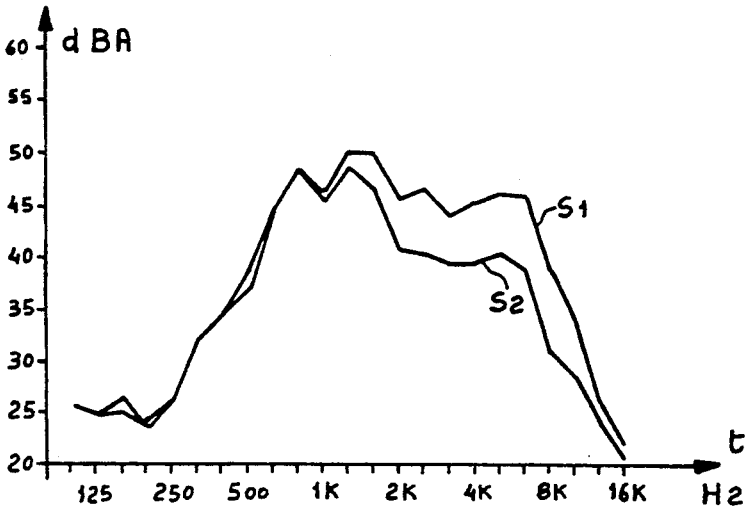
FIG. 7 is an operational diagram showing the spectrum of acoustic frequencies produced by the device shown in FIG. 1.

FIG. 7 shows at 'S1' and 'S2' the acoustic spectra of the printing noises of a typewriter respectively using the striker device of said European application 0 206 701 and that of the device 10 according to the present invention. The two curves 'S1' and 'S2' were plotted using a mode of operation of the machine and with a measuring methodology in accordance with the standard ISO 7779. The two spectra have a first common range up to about 1.5 kHz, which is relative to the specific mechanisms of the machine which are not to be attributed to the striker device, and a second range of between 1.5 kHz and 16 kHz which can be predominantly attributed to the striker device. In the second frequency range the spectrum S2 exhibits a substantial reduction in strength with a significant gain in terms of noise nuisance.

Figure 8A:
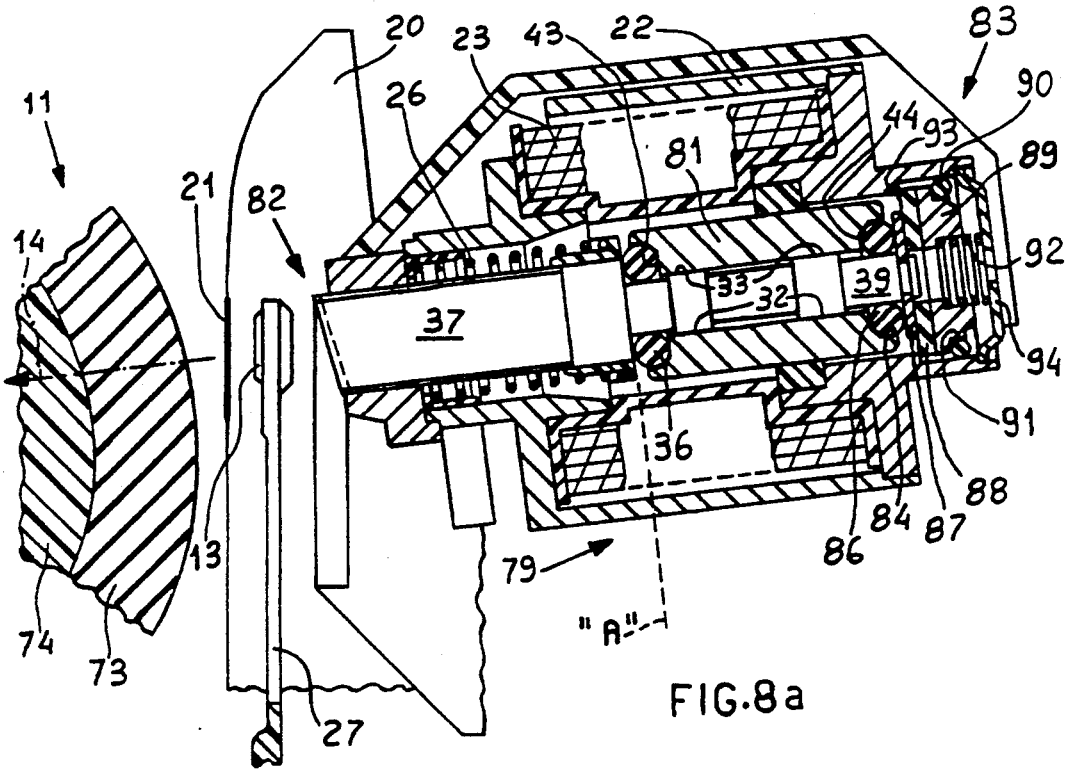
FIG. 8*a* shows an alternative form of the device illustrated in FIG. 1.

FIG. 8*a* shows an alternative form of the device 10, indicated herein by reference numeral 79, in which many parts including the stator body are identical to those of the device 10 and thus are illustrated herein by means of the same reference numeral. The changes concern the movable armature which is indicated at 81, the print hammer indicated herein at 82 and the travel-limiting damping assembly indicated herein at 83.

The armature 81 is also slidable with respect to the hammer 82 by means of the guide surfaces 32 and 33. In this embodiment the surface 44 is provided at the bottom of an annular recess 84 and the armature 81, besides being connected to the hammer 82 by the ring 36, is also connected to the hammer 82 by a second toroidal ring (O-ring) 86 of elastomeric material which is identical to the ring 36 and which is accommodated in the recess 84 at the transverse surface 44 of the armature 81 and a washer 87 which is fixed to the end of the terminal portion 39 of the hammer 82. In the rest position 'A' of the hammer 82, the washer 87 bears against a ring 88 of viscoelastic material, which is fixed on a counterweight block 89 of cylindrical shape, which in its rear part accommodates a toroidal ring 90 guided slidably on a sliding guide surface 91 of the rear portion 49. The counterweight body 89 is urged in the direction 14 by a counteracting spring 92. The block 89 is arrested with the ring 88 against an intermediate stop 93 of the portion 49 due to the force of the counteracting spring 92 which prevails over the force of the return spring 26 acting on the assembly consisting of the hammer 82 and the armature 81. The toroidal ring 90 is thus interposed with play between the block 89 and a travel-limiting wall 94 fixed to the rear portion 49 of the stator block 22.

Figure 8B:
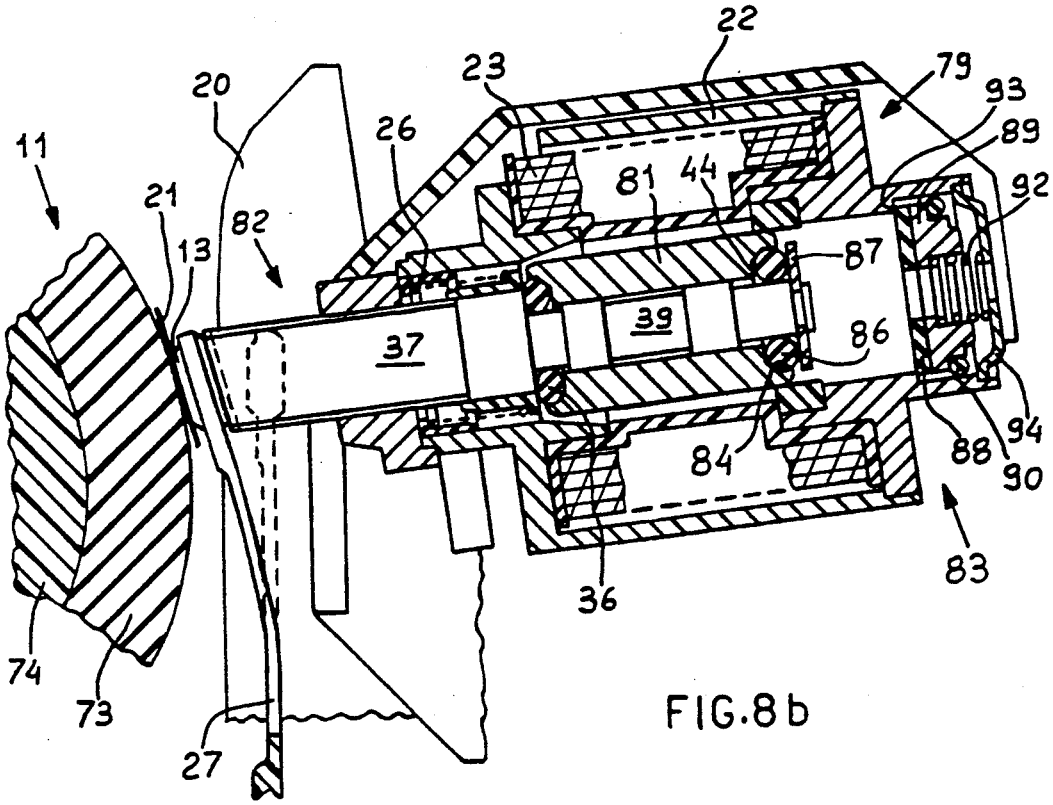
FIG. 8*b* shows the device illustrated in FIG. 8 in an operating position.

The performance of the striker device 79 as shown in FIG. 8*b* during printing of the character 13 is very similar to that of the device 10 and is therefore not repeated herein. In the phase involving return of the hammer 82 to the rest position, the ring 86 is capable of absorbing a first part of the residual energy of the hammer 82. The counterweight body 89 and the counteracting spring 92 then receive a second part of the energy from the hammer 82 and the armature 81 and the toroidal ring 90 absorbs a part of the kinetic energy of the counterweight block 89, in a similar manner to the situation described in said European patent application 0 206 701. In the case of the damping assembly 83, the ring 88, on striking against the stop 93, also contributes to dissipation of the energy accumulated in the counteracting spring 92. The device 79 is advantageous in high-speed printers in which there is a wish to reduce the time involved in damping of the hammer after the operation of printing a character.

FIG. 9 shows a second alternative embodiment of the striker device according to the invention, indicated herein at 95, in which all the parts except the movable armature and the guide bush, indicated herein at 96 and 97, are identical to those of the device 10 and are identified by the same references.

The armature 96 is of a hollow cylindrical structure similar to that of the armature 24 but does not have any annular recess in the front part thereof. The first terminal surface of the armature 96 which faces towards the roller 11, that surface being indicated herein at 98, defines a frustoconical surface 99 which is provided at the front of the armature 96 on the side surface thereof and which is disposed facing the negative frustoconical surface of the pole piece 71. The bush 97 in turn has thin walls and provides for extensive contact with the surface of the armature 96.

It is clear that modifications and alterations may be made in the above-described striker devices without thereby departing from the scope of the invention.

By way of example, the element of elastomeric material may be of different shapes from that illustrated and it may be connected to the armature 24, 81 and the hammer 16, 82 in a different manner, to operate in a tensile or flexural mode. In addition the material from which it can be made may be of a different type from that indicated, for example it may be made of silicone rubber or alternatively plastics materials, according to particular requirements.

In the case in which the armature is also connected to the hammer in the opposite direction to the impact direction (FIG. 8*a*), the return spring 26 may operate on the armature instead of the hammer. The freedom of movement of the armature with respect to the hammer may also be provided by independent guide means for the two components.

The guide means for the hammer and/or for the armature may also comprise pivoting elements for an impact direction of curved type.

Finally the movement of the armature may be produced in a negative mode, by virtue of the action of an actuating spring and against the action of a stator magnetic field, such that release of the armature may take place by virtue of the action of an oppositely acting magnetic field induced by a suitable winding.

What is claimed is:

1. In a striker device for printers, comprising a printing support; a character-carrying member having individually movable characters; a print hammer which is actuatable in an impact sense and direction to strike a selected character of said character-carrying member against said printing support; and an actuating member for actuating said hammer, said actuating member being movable together with the print hammer during striking of said character, wherein the improvement comprises silencer means including:

guide means for movably supporting said actuating member freely with respect to said print hammer in the impact sense and direction; and an element of elastomeric material interconnecting said actuating member and said print hammer along the impact direction;

wherein said element of elastomeric material is deformable in response to a reciprocal movement of the actuating member with respect to the print hammer along the impact sense and through said guide means for transmitting with delay kinetic energy from said actuating member to said hammer upon the striking of the selected character against said printing support.

2. Apparatus according to claim 1, wherein the print hammer and the actuating member have respective hammer mass and actuating mass which are in an inertial relationship included between 0.25 and 1; and wherein the element of elastomeric material and the platen roller have levels of rigidities which are included between 0.5 and 1 to prolong the action of the printing action of said hammer, without causing repetition thereof.

3. Apparatus according to claim 1, in which said actuating member has a hollow axial portion for accommodating a portion of said hammer.

4. Apparatus according to claim 3, in which said guide means comprise means for making a sliding connection between said hollow portion of said actuating member and said print hammer in said impact direction.

5. Apparatus according to claim 1, in which said print hammer and said actuating member each comprise an elongate body with an external surface parallel to said impact direction, and said guide means comprise first and second fixed bushes for guiding said hammer and said actuating member respectively in said impact direction and sliding cylindrical coupling surfaces between said actuating member and said hammer.

6. Apparatus according to claim 1, in which said element of elastomeric material is interposed between two oppositely-disposed surfaces of said print hammer and said actuating member respectively, which surfaces are transverse with respect to said impact direction, for applying a compression force to said element of elastomeric material.

7. Apparatus according to claim 6, in which said element of elastomeric material is in the form of a ring and embraces an intermediate portion of said print hammer.

8. Apparatus according to claim 7, in which said actuating member is of circular section and said ring is a toroidal ring (O-ring) with a cross-section of a diameter of between 18% and 24% of the diameter of said circular section.

9. A striker device according to claim 1, in which said elastomeric element is of a hardness of between 55 and 80 Shore A for a printing support of a hardness of between 45 and 60 Shore D.

10. Apparatus according to claim 9, in which said element of elastomeric material is of a hardness of 70±5 Shore A.

11. Apparatus according to claim 1, in which the relationship between the levels of rigidity of said element of elastomeric material and said printing support is between 0.25 and 1.

12. Apparatus according to claim 1, in which the inertial relationship between the mass of said hammer and the mass of said actuating member is of a value of between 1 and 0.25.

13. Apparatus according to claim 12, in which said inertial ratio is 0.65±0.05.

14. Apparatus according to claim 1, in which said element of elastomeric material is made of fluorinated rubber.

15. Apparatus according to claim 1, in which said element of elastomeric material is made of silicone rubber.

16. Apparatus according to claim 1, further comprising a travel-limiting damping assembly capable of cooperating with a stop surface of said actuating member for defining a rest position of said print hammer, and a return spring which acts on said hammer for returning said hammer towards said rest position together with said actuating member.

17. Apparatus according to claim 16, in which said damping assembly comprises a ring of elastomeric material with a fixed travel-limiting surface in opposite relationship thereto.

18. Apparatus according to claim 16, in which said damping assembly comprises a counterweight mass spring-loaded against a fixed abutment and movable from said abutment beyond a predefined rest position.

19. Apparatus according to claim 1, further comprising a stator body adapted for electromagnetic excitation, and an excitation circuit actuable to excite said stator body, and wherein said actuating member comprises an armature movable along a line of impact travel in response to electromagnetic excitation of said stator body, said circuit being capable of supplying said stator body with variable pulse energy operative for a fraction of the travel of said actuating member, for ballistic impact of said hammer.

20. In a striker device for printers, comprising a printing support; a character-carrying member of having individually movable characters; a print hammer which is actuatable in an impact sense and direction to cause a selected character of said character-carrying member to strike against said printing support; and an actuating member movable to actuate said hammer, wherein the improvement comprises silencer means comprising:

guide means capable of ensuring freedom of movement for said actuating member with respect to said print hammer in said impact sense and direction;

an element of elastomeric material interposed between said actuating member and said print hammer such as to transmit kinetic energy from said actuating member to said hammer with a delay, in which said element of elastomeric material is interposed between two oppositely-disposed surfaces of said print hammer and said actuating member respectively, which surfaces are transverse with respect to said impact direction, for applying a compression force to said element of elastomeric material; and a second element of elastomeric material which is interposed between two other oppositely-disposed surfaces of said actuating member and said print hammer respectively, and which can be subjected to a compression effect in response to a reciprocal movement of said actuating member with respect to said print hammer in said impact direction and opposite thereto.

21. Apparatus according to claim 20, in which said second element of elastomeric material is identical to said first element.

22. Apparatus according to claim 20, further comprising a travel-limiting damping assembly capable of cooperating with a stop surface of said print hammer to define a rest position of said hammer, and a return spring for returning said print hammer towards said rest position together with said actuating member.

23. A striker device for printers of the type comprising a platen roller; a character-carrying disc having characters carried by blades which are movable individually in an impact direction and sense; a print hammer which can be actuated to cause a selected character of said character-carrying disc to strike against said platen roller; an actuating unit for the print hammer which is provided with a stator body adapted for electromagnetic excitation and ferromagnetic armature capable of movement together with the hammer and in response to excitation of the stator body to actuate said hammer; and a return spring for returning the hammer towards a rest position, said print hammer and said ferromagnetic armature having a hammer mass and an armature mass respectively, wherein the improvement comprises silencer means comprising:

guide means for causing said armature to be freely movable with respect to said print hammer in said impact sense and direction; and an element of elastomeric material interposed between said armature and said print hammer such as to transmit kinetic energy from said armature to said hammer with delay upon the striking of the selected character with a reciprocal movement of said actuating member with respect to said print hammer in said impact sense and direction, through said guide means;

wherein the hammer mass and the armature mass are in an inertial ratio included between 0.25 and 1; and wherein the element of elastomeric material and the platen roller have levels of rigidities which are in a rigidity ratio included between 0.25 and 1 to prolong the action of the printing action of said hammer.

24. Apparatus according to claim 23, in which said element of elastomeric material comprises a toroidal ring (O-ring).

25. Apparatus according to claim 23, in which said intertial ratio is 0,66±0,2.

26. Apparatus according to claim 23, wherein said element of elastomeric material has a hardness of between 65 and 75 Shore A and wherein the platen roller comprises a sheath having a hardness of between 52±2 such as to provide a level rigidity ratio of about 0.5.

* * * * *